US006882252B1

(12) United States Patent
Cros et al.

(10) Patent No.: US 6,882,252 B1
(45) Date of Patent: Apr. 19, 2005

(54) MULTI-LAYER MICROWAVE RESONATOR

(75) Inventors: Dominique Cros, Linoge Cedex (FR); Michael Edmund Tobar, Nedlands (AU)

(73) Assignees: Poseideon Scientific Instruments Pty Ltd., Fremantle (AU); The University of Western Australia, Nedlands (AU)

( * ) Notice: Subject to any disclaimer, the term of this patent is extended or adjusted under 35 U.S.C. 154(b) by 168 days.

(21) Appl. No.: 09/914,142

(22) PCT Filed: Dec. 21, 2000

(86) PCT No.: PCT/AU00/01579

§ 371 (c)(1),
(2), (4) Date: Jun. 21, 2003

(87) PCT Pub. No.: WO01/48856

PCT Pub. Date: Jul. 5, 2001

(30) Foreign Application Priority Data

Dec. 23, 1999 (AU) ..... PQ 4877

(51) Int. Cl.[7] ..... H01P 7/10
(52) U.S. Cl. ..... 333/219.1; 333/234; 333/202
(58) Field of Search ..... 333/219.1, 202, 333/234

(56) References Cited

U.S. PATENT DOCUMENTS 4,661,790 A * 4/1987 Gannon et al. ..... 333/234
4,692,727 A * 9/1987 Wakino et al. ..... 333/219
4,706,052 A * 11/1987 Hattori et al. ..... 333/219
5,059,929 A * 10/1991 Tanaka ..... 333/219.1
5,221,913 A * 6/1993 Ishizaki et al. ..... 333/219.1
5,315,274 A * 5/1994 Sarkka ..... 333/219.1
6,255,922 B1 * 7/2001 Malmstrom et al. ..... 333/219.1

* cited by examiner

*Primary Examiner*—Robert Pascal
*Assistant Examiner*—Stephen E. Jones
(74) *Attorney, Agent, or Firm*—Clark Hill PLC

(57) ABSTRACT

A multi-layer microwave resonator (10) comprises a cavity (12) having an inner surface formed from an electrically conductive material. Pieces (16*a*–16*e*) of dielectric materials stacked on top of each other form a conriguous body (14) that is provided in the cavity (12). The dielectric materials of the pieces (16*a*–16*e*) are chosen such that the dielectric constant of the pieces (16*a*–16*e*) alternate between a relatively high dielectric constant and a relatively low dielectric constant.

17 Claims, 7 Drawing Sheets

MULTI-LAYER MICROWAVE RESONATOR

This application is a 371 of International Application No. PCT/AU00/01579, filed on Dec. 21, 2000, which designated the United States and which is published in English.

FIELD OF THE INVENTION

This invention relates to a multi-layer microwave resonator. In this respect, the term 'microwave' is used in this specification to denote the range of frequencies that the invention may be useful, and includes microwave frequencies, millimetre wave frequencies and quasi-optical frequencies, in the frequency range of 1 GHz to 100 GHz.

BACKGROUND ART

Modern radar and telecommunications systems require high frequency signal sources and signal processing systems with stringent performance requirements and extremely good spectral purity. Thus, there is a need for signal processing systems and signal sources with ever increasing spectral purity, stability and power-handling requirements.

Resonators, by their nature, provide discrimination of wanted signals from unwanted signals. The purity and stability of the signals produced is directly linked to the resonator used as the frequency determining device and is dependant upon its Q-factor, power handling ability and its immunity to vibrational and temperature related effects.

It is known that a piece of dielectric material has self-resonant modes in the electromagnetic spectrum that are determined by its dielectric constant and physical dimensions. The spectral properties of a given mode in a piece of dielectric material are determined by the intrinsic properties of the dielectric material, its geometric shape, the radiation pattern of the mode and properties and dimensions of the materials surrounding or near the dielectric material.

Prior art resonators have traditionally relied on metallic cavities containing no dielectric material, or on metallic cavities containing a dielectric material which were limited in Q-factor by the properties and dimensions of the metallic cavities. These prior art resonators were commonly operated at cryogenic temperatures in order to obtain a better Q-factor. However, to maintain cryogenic temperatures requires equipment which is cumbersome and difficult to incorporate into a portable or compact apparatus.

U.S. Pat. No. 5,712,605 to Flory and Taber describes a resonator structure that seeks to address these problems. The resonator described in U.S. Pat. No. 5,712,605 is a complex stack of hollow cylinders and flat discs formed of dielectric material. The cylinders and discs are enclosed within a metal cavity, with the hollow cylinders and discs forming a series of axially aligned cavities. The length of the cylinders and the diameter of the discs determine the operating mode of the resonator. The resonator is described as offering a high Q-factor.

Although the resonator described in U.S. Pat. No. 5,712,605 offers a high Q-factor, there are several disadvantages associated with the resonator structure. These include the difficulty of manufacture and its sensitivity to vibration. The device is difficult to manufacture because the hollow cylinders must be perfectly coaxial or the operation of the resonator will be significantly impaired. Further, because the resonant cavities are defined by the dielectric discs and hollow cylinders, any vibration or movement induced in one or more of the dielectric hollow cylinders or discs will result in a corresponding change in the shape of the resonant cavity, with a resulting change in the resonant frequency. This is referred to as mode breaking and has limited the usefulness of this resonator structure.

C. J. Maggiore et al describe a further resonator structure in their paper "Low-loss microwave cavity using layered-dielectric materials", Appl. Phys. Lett. Vol 64 No 11, p1451. This resonator comprises a hollow, cylindrical copper cavity with one to four circular dielectric plates placed in parallel and axially spaced within the cavity. The Q-factor of the resonator was observed by Maggiore et al to increase as more dielectric plates were used.

Maggiore et al acknowledge at p1453 that although the Q-factor of the resonator at room temperature is high enough to have application to frequency stabilised oscillators, it will be necessary to thermally stabilise the cavity. This is because the dielectric plates are held in the cavity by means of circumferential grooves cut in the cavity wall. Copper has a thermal expansion coefficient of $16.8\times10^{-6}$; thus a 1° Celsius temperature change will produce a 3.5 MHz change in operating frequency of a 19 GHz resonator, which is due to the change in spacing between the dielectric plates resulting from the expansion/contraction of the copper cavity.

DISCLOSURE OF THE INVENTION

Throughout the specification, unless the context requires otherwise, the word "comprise" or variations such as "comprises" or "comprising", will be understood to imply the inclusion of a stated integer or group of integers but not the exclusion of any other integer or group of integers.

In accordance with one aspect of this invention, there is provided a multi-layer microwave resonator, comprising:

- a cavity having an inner surface formed from an electrically conductive material;
- a plurality of pieces of dielectric materials stacked on top of each other to form a contiguous body, the body being provided in the cavity;
- wherein the dielectric materials of the pieces are chosen such that the dielectric constant of the pieces alternate between a relatively high dielectric constant and a relatively low dielectric constant.

Preferably, the dielectric materials of the pieces are chosen such that the thermal coefficient of dielectric constant of the pieces alternate between a positive thermal coefficient of dielectric constant and a negative thermal coefficient of dielectric constant.

Preferably, the body includes a central piece of dielectric material having a relatively low dielectric constant.

Preferably, the central piece has a length substantially commensurate with an integer multiple of one-half wavelength of a desired operating frequency in the dielectric material.

In one arrangement of the invention:

- the body is formed of three pieces of dielectric materials, arranged as a central piece of a first dielectric material and two end pieces of a second dielectric material, the central piece being provided between the two end pieces;
- the central piece of dielectric material having a length substantially commensurate with an integer multiple of one half wavelength of a desired operating frequency in said first dielectric material;
- each end piece having a length substantially commensurate with an odd integer multiple of one-half wavelength of the desired operating frequency in the second dielectric material;

the dielectric constant of the second dielectric material being greater than the dielectric constant of the first dielectric material.

A preferred form of this arrangement further comprises:

an even plurality of intermediate pieces of dielectric materials provided between the central piece and each end piece;

each intermediate piece being formed from either the first dielectric material or the second dielectric material;

each intermediate piece having a length substantially commensurate with an odd integer multiple of one-quarter wavelength of the desired operating frequency in whichever of the first or second dielectric material the intermediate piece of formed from;

the intermediate pieces provided between the central piece and each end piece comprise an equal number of intermediate pieces formed from the first dielectric material and intermediate pieces formed from the second dielectric material;

the intermediate pieces being arranged such that the pieces of dielectric materials forming the body alternate between pieces formed from the second dielectric material and pieces formed from the first dielectric material.

In an alternative arrangement of the invention:

the body is formed of five pieces of dielectric materials, arranged as a central piece of a first dielectric material, two intermediate pieces of a second dielectric material and two end pieces of the first dielectric material, the central piece being provided between the two intermediate pieces, the central piece and the intermediate pieces being provided between the two end pieces;

the central piece of dielectric material having a length substantially commensurate with an integer multiple of one-half wavelength of a desired operating frequency in said first dielectric material;

each intermediate piece having a length substantially commensurate with an odd integer multiple of one-quarter wavelength of the desired operating frequency in the second dielectric material;

each end piece having a length substantially commensurate with an odd integer multiple of one-quarter wavelength of the desired operating frequency in the first dielectric material;

the dielectric constant of the second dielectric material being greater than the dielectric constant of the first dielectric material.

A preferred form of this arrangement further comprises:

an odd plurality of intermediate pieces of dielectric materials are provided between the central piece and each end piece;

each intermediate piece being formed from either the first dielectric material or the second dielectric material;

each intermediate piece having a length substantially commensurate with an odd integer multiple of one-quarter wavelength of the desired operating frequency in whichever of the first or second dielectric material said intermediate piece is formed from;

the intermediate pieces provided between the central piece and each end piece comprise alternate between an intermediate piece formed from the second dielectric material and an intermediate piece formed from the first dielectric material;

the intermediate pieces being arranged such that the pieces of dielectric materials forming the body alternate between pieces formed from the first dielectric material and pieces formed from the second dielectric material.

Preferably, each intermediate piece formed from the second dielectric material has an aperture formed centrally therein.

Preferably, each intermediate piece formed from the first dielectric material has an aperture formed centrally therein.

Preferably, the central piece has an aperture formed centrally therein.

Preferably, each end piece formed has an aperture formed centrally therein.

Preferably, the central piece has an opening formed therein for receiving test substances.

Preferably, the first dielectric material is sapphire.

Preferably, the second dielectric material is rutile.

Preferably, the pieces of dielectric material are substantially cylindrical.

Preferably, the cavity comprises a cylindrical wall and two ends, the body being contained between the ends of the cavity.

In one arrangement, the cylindrical wall is spaced from the body.

In an alternative arrangement, the cylindrical wall abuts the body.

BRIEF DESCRIPTION OF THE DRAWINGS

The invention will be better understood with reference to the following description of six specific embodiments thereof and the accompanying drawings, which;

FIG. 2(*c*) is an elevation cross-section of the muti-player microwave resonator shown in FIGS. 2(*a*) and 2(*b*) showing the distribution of electromagnetic fields within the microwave resonator;

BEST MODE(S) FOR CARRYING OUT THE INVENTION

The embodiments are directed towards multi-layer microwave resonators which can be used in a variety of applications. The microwave resonators are intended to provide a relatively high Q-factor and operate in a low order mode to reduce spurious modes. The relatively solid constructions reduces the vibrational sensitivity of the device.

Figure 1A:
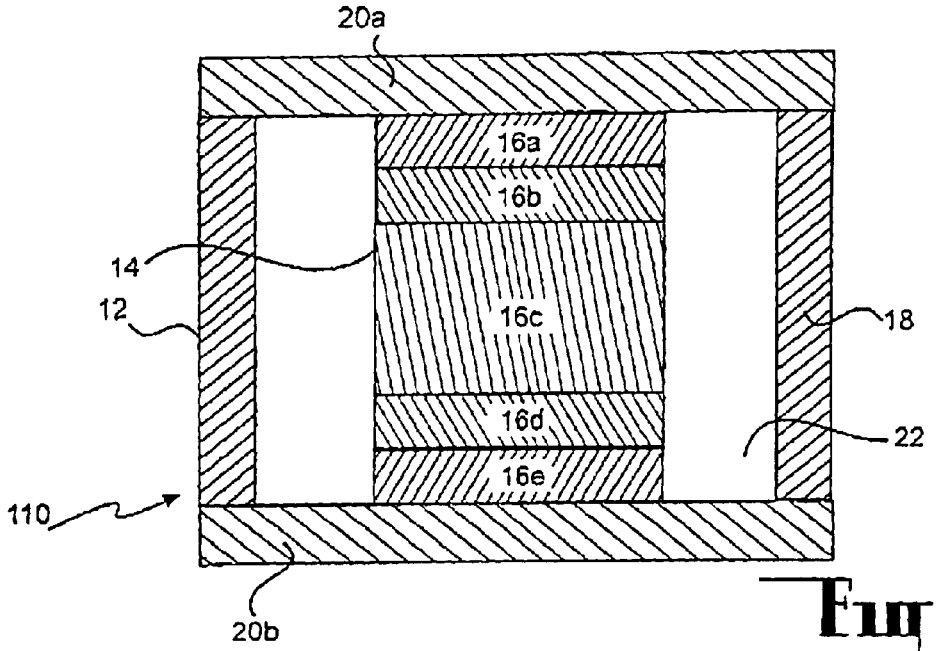
FIGS. 1(*a*) and 1(*b*) are elevation and plan cross-sections, respectively, of a multi-layer microwave resonator in accordance with a first aspect of this invention.
Figure 1B:
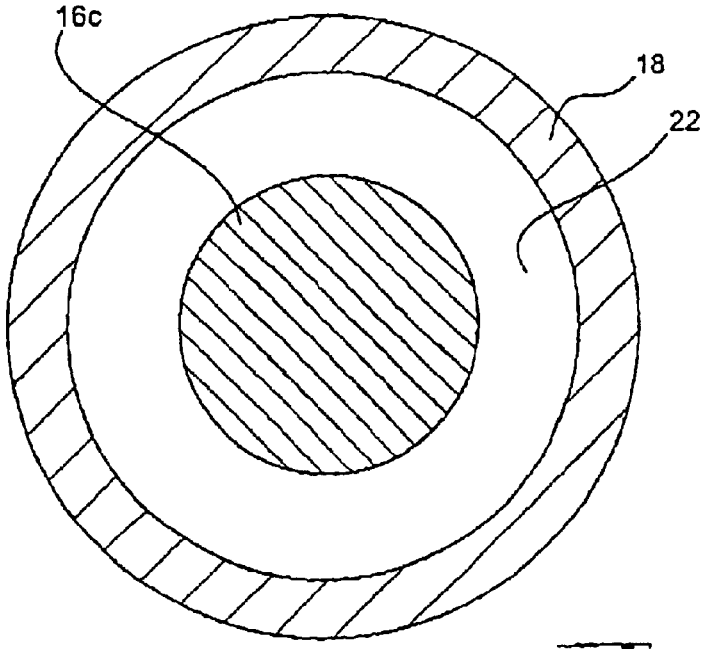

The first embodiment is directed towards a microwave resonator 10 comprising a cavity 12 and a body 14 that is formed from five pieces of dielectric material 16(*a*)–16(*e*) stacked on top of each other, as shown in FIGS. 1*a* and 1*b*.

The cavity 12 comprises a cylindrical wall 18 and two end sections 20(*a*) and 20(*b*). The cylindrical wall 18 and the end sections 20(*a*) and 20(*b*) are formed from copper. In other embodiments, the wall and end sections may be formed from other electrically conductive materials, or may have an inner surface coated with such a material. For best performance, it is preferred that the electrically conductive material have a low impedance, such as silver or copper.

The body 14 is provided within the cavity 12 coaxially with the cylindrical wall 18. The body 14 is held in place between the end sections 20(*a*) and 20(*b*). If desired, recesses of an appropriate shape may be formed in the end sections 20(*a*) and 20(*b*) to more securely hold the body 14 in position within the cavity 12.

The cylindrical wall 18 is spaced from the body 14 in the embodiment to define an annular air filled or vacuum space 22.

The body 14 may be retained within the cavity 12 by holding it in compression between the end sections 20*a* and 20*b* of the cavity 12.

Further, the pieces of dielectric material 16*a*–16*e* may be heated so that adjacent pieces 16*a*–16*e* fuse together to form a single body, though this is not essential.

Each of the pieces of dielectric material 16(*a*)–16(*e*) are solid cylinders in shape in this embodiment. The piece 16(*c*) forms a central piece of the body 14, having pieces 16(*b*) then 16(*a*) stacked on top of it and pieces 16(*d*) and 16(*e*) stacked below it. The pieces 16(*a*) and 16(*e*) form end pieces of the body 14, with the pieces 16(*b*) an 16(*d*) being intermediate pieces between the end pieces 16(*a*) and 16(*e*) and the central piece 16(*c*).

The central piece 16(*c*) and the end pieces 16(*a*) and 16(*e*) are formed of sapphire as the dielectric material in this embodiment. The intermediate pieces 16(*b*) and 16(*d*) are formed with rutile as the dielectric material in this embodiment. Rutile is known to have a higher dielectric constant than sapphire and so, in relative terms, the dielectric constant in the body goes as low, high, low, high, low. In this regard, what is important is that the dielectric constant of the dielectric material from which the pieces 16(*b*) and 16(*d*) are made from is higher than the dielectric constant of the dielectric material from the layers 16(*a*), 16(*c*) and 16(*e*) are made from, rather than their absolute values.

A further advantage of rutile as a dielectric material is that its temperature coefficient of dielectric constant is positive, whereas most other dielectric materials have a negative dielectric constant. When used in the body 14, the rutile in pieces 16(*b*) and 16(*d*) act to offset the temperature coefficient of dielectric constant of the sapphire in pieces 16(*a*), 16(*c*) and 16(*e*). This reduces the sensitivity of the resonator 10 to temperature variations.

The length in the axial direction of each of the pieces of dielectric materials 16(*a*)–16(*e*) is determined according to the wavelength of a desired operating frequency within the respective piece of dielectric material. In this regard, the central piece 16(*c*) has an axial length corresponding with one half wavelength at the desired frequency, the intermediate pieces 16(*b*) and 16(*d*) have an axial length corresponding with one quarter wavelength of the desired frequency, and end pieces 16(*a*) and 16(*e*) each have a length corresponding with one quarter wavelength at the desired frequency. Although the axial length of the central piece 16(*c*) can be any multiple of one half wavelength, and the axial length of pieces 16(*a*), 16(*b*), 16(*d*) and 16(*e*) can be any odd multiple of one quarter wavelength, it is preferred that a single multiple is used to minimise spurious modes. It also minimises the size of the device where space is at a premium.

The operating frequency of the microwave resonator 10 can be tuned a follows. Firstly, coarse tuning can be achieved by selecting the axial length of each of the pieces of dielectric materials 16(*a*)–16(*e*) as described above. However, the machining process that creates the pieces 16(*a*)–16(*e*) is not accurate enough to achieve exact dimensions. Thus, medium frequency tuning can be achieved by adjusting the diameter of the cylindrical wall 18, such as by machining. Fine adjustment of the operating frequency can be achieved by temperature regulation.

Figure 2A:
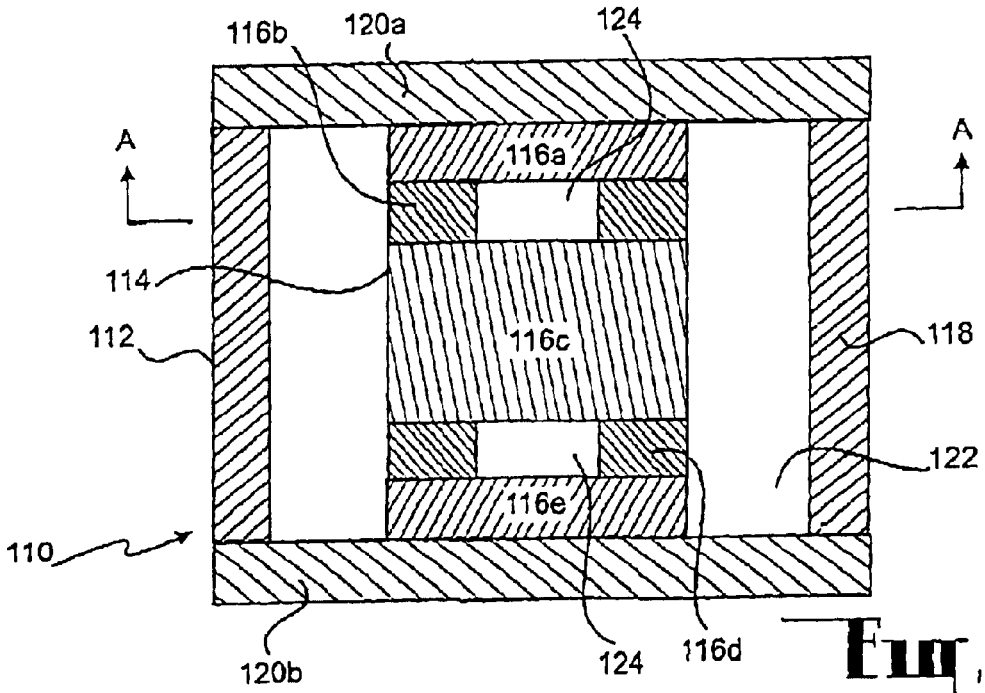
FIGS. 2(*a*) and 2(*b*) are elevation and plan cross-sections, respectively, of a multi-layer microwave resonator in accordance with a second embodiment of this invention.
Figure 2B:
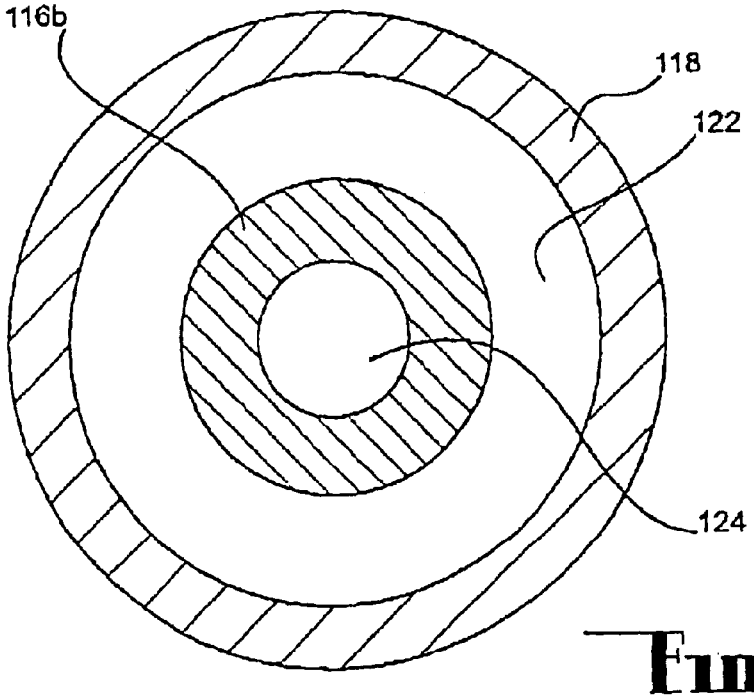
Figure 2C:
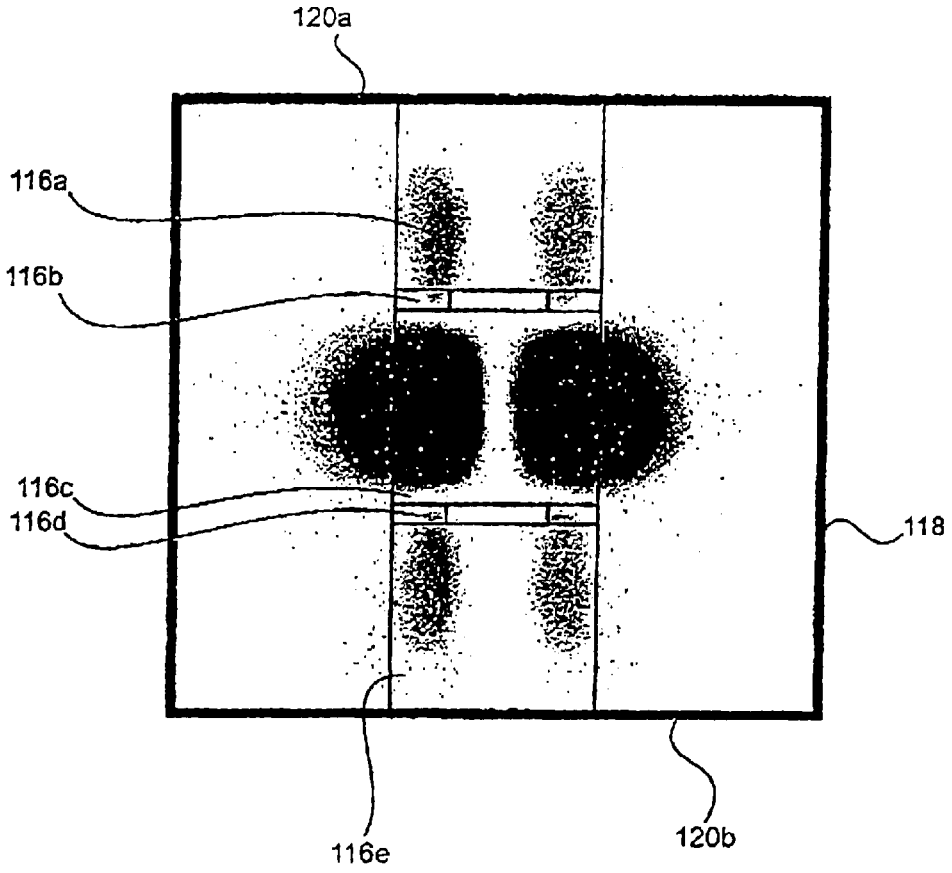

The second embodiment is shown in FIGS. 2(*a*) and 2(*b*). FIG. 2(*b*) is a cross-section through lines A—A in FIG. 2(*a*). The second embodiment is directed towards a multi-layer microwave resonator 110 of the same general form as the microwave resonator 10 described in the first embodiment. Like reference numerals are used to denote like parts to those shown in the first embodiment, with 100 added thereto.

The multi-layer microwave resonator 110 differs from the microwave resonator 10 in the first embodiment in that the intermediate pieces 116(*b*) and 116(*d*) of rutile each have a circular aperture 124 formed therein. The aperture 124 can be left empty or filled with a very low loss, low dielectric constant dielectric material. It should be appreciated that the length of the pieces of dielectric material 116*a*–116*e* do not need to necessarily have lengths exactly corresponding to a multiple of a quarter or half wavelength, as appropriate. Rather, these values provide guides for construction of the resonators. In some instances, it may be desirable to vary the length of some of the pieces of dielectric material to optimise desired characteristics of the resonator. For example, the resonator shown in FIGS. 2*a* and 2*b* were entered into a finite element electromagnetic analysis tool, with parameters that the length of each piece of dielectric material may be varied slightly, and the characteristic to optimise was chosen as the Q-factor of the resonator. After several iteratiors of analysis, the structure with the highest Q-factor is that shown in FIG. 2*c*. As can be seen, the length of the end pieces has increased to substantially that of the centre piece.

FIG. 2(*c*) also shows the distribution of electromagnetic energy within the Q-factor optimised resonator 110.

Figure 3A:
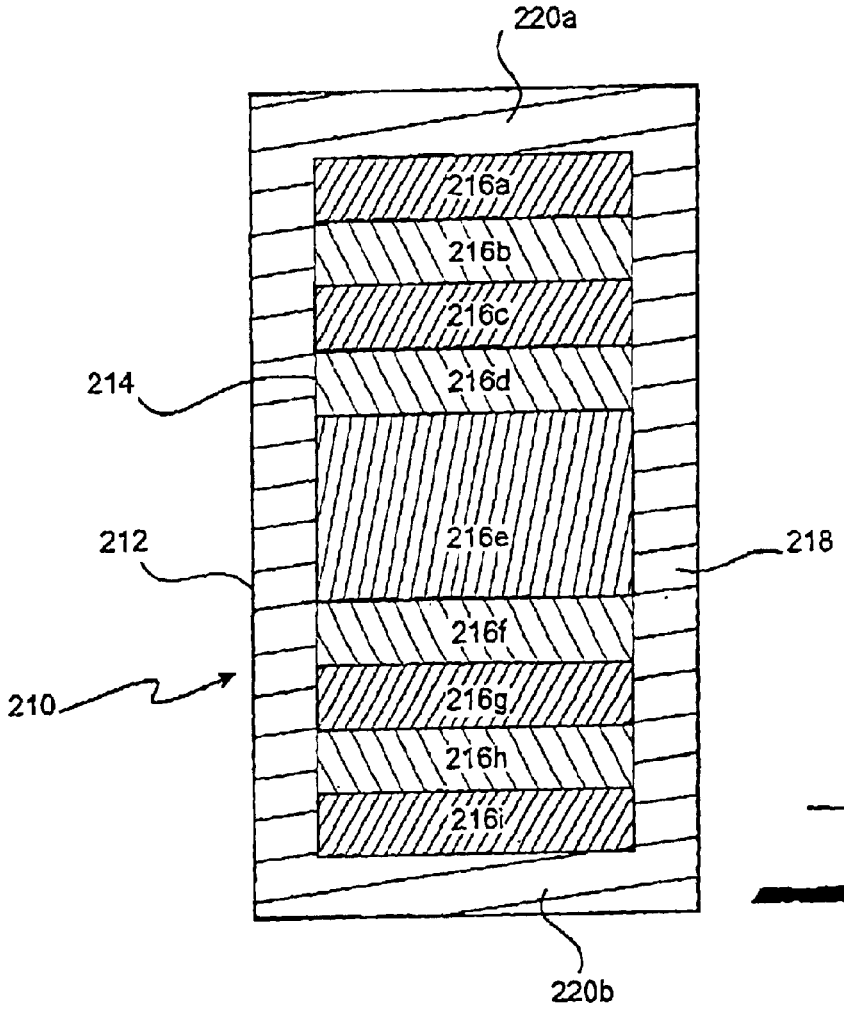
FIGS. 3(*a*) and 3(*b*) are elevation and plan cross-sections of a multi-layer microwave resonator in accordance with a third embodiment of this invention.
Figure 3B:
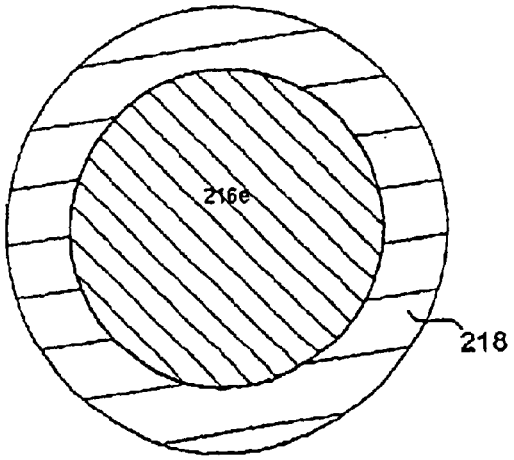

The third embodiment is directed towards a multi-layer microwave-resonator 210, as shown in FIGS. 3(*a*) and 3(*b*). Like reference numerals they used to denote like parts in those in the first embodiment, with 200 added thereto.

The microwave resonator 210 differs from the microwave resonator 10 in the first embodiment in that the body 214 in this embodiment is formed from nine pieces 216*a*–216*i* of dielectric materials. In the current embodiment, the piece 216*e* forms the central piece of the body 214, with intermediate pieces 216*d*, 216*c*, 216*b* and finally end piece 216*a* stacked on top of it and intermediate pieces 216*f*, 216*g*, 216*h* and finally end piece 216*i* stacked below it.

The pieces 216*a*, 216*c*, 216*e*, 216*g* and 216*i* are formed from sapphire. The pieces 216*b*, 216*d*, 210*f* and 216*h* are formed rutile. Each of the pieces 216*a*–216*d* and 216*f*–216*i* have an axial length commensurate with one quarter wavelength in the corresponding dielectric material. Increasing the number of layers offers a higher Q-factor, but at the expense of increased complexity of manufacture. Conceptually, further pieces of dielectric material can be added to a body ad infinitum, but each subsequent piece offers diminishing returns.

Further, in the microwave resonator 210 of the current embodiment, the cylindrical wall 18 abuts the body 214.

Figure 4A:
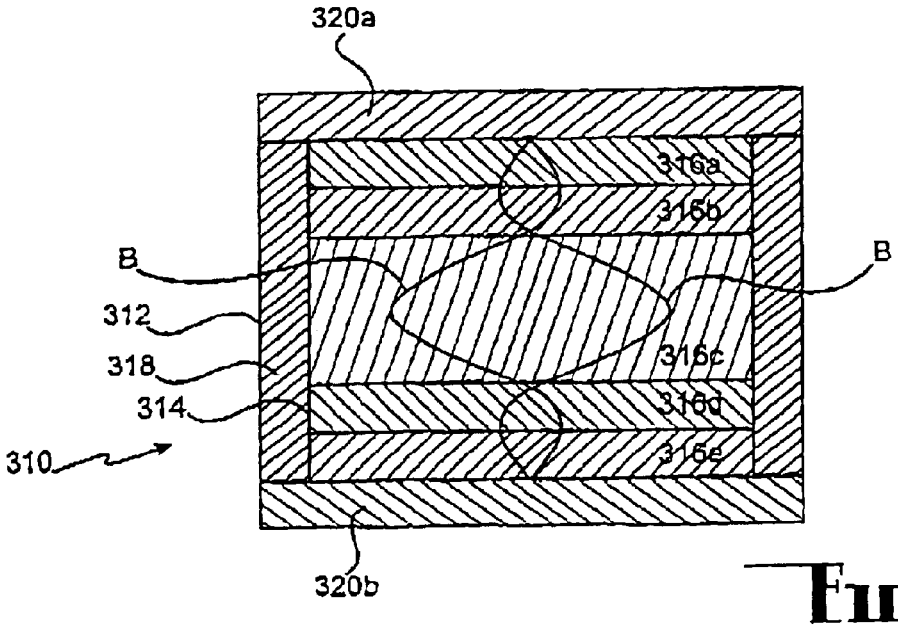
FIGS. 4(*a*) and 4(*b*) are elevation and plan cross-sections of a multi-layer microwave resonator in accordance with a fourth embodiment of the invention, in which FIG. 4(*a*) also includes a illustrative representation of electromagnetic fields within the microwave resonator.
Figure 4B:
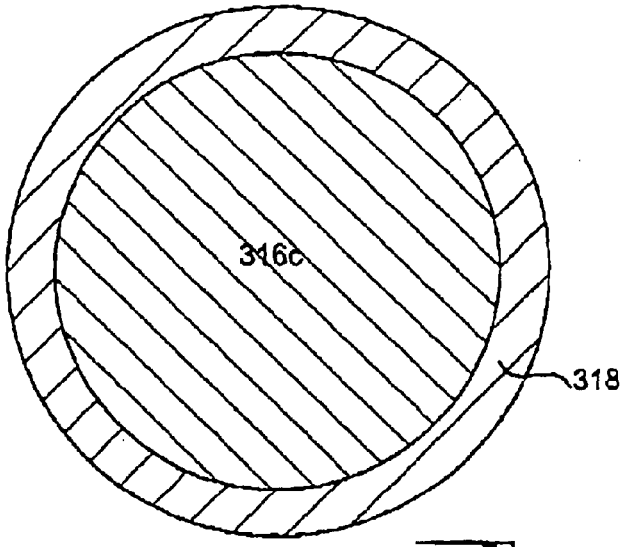

The fourth embodiment is directed towards a microwave resonator 310, shown in FIGS. 4(*a*) and 4(*b*). Like reference numerals they are used to denote like parts to those used in the first embodiment, with 300 added thereto.

The microwave resonator 310 in the current embodiment is of the same general form as the microwave resonator 10 in the first embodiment, the only difference being that the diameter of the pieces 316*a*–316*e* are greater than the corresponding pieces 16*a*–16*e* in the first embodiment. Further, the wall 318 abuts the body 314 in this embodiment.

The lines marked B in FIG. 4(*a*) offer an illustrative representation of the electro-magnetic field present in the resonator 310.

Figure 5A:
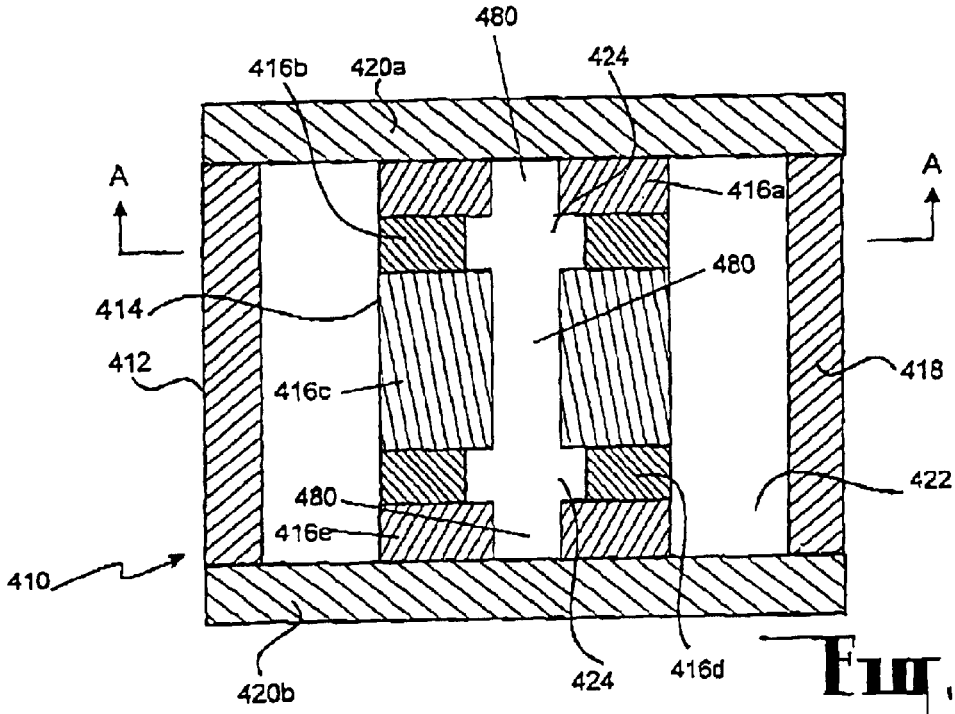
FIGS. 5(*a*) and 5(*b*) are elevation and plan cross-sections of a multi-layer microwave resonator in accordance with a fifth embodiment of this invention.
Figure 5B:
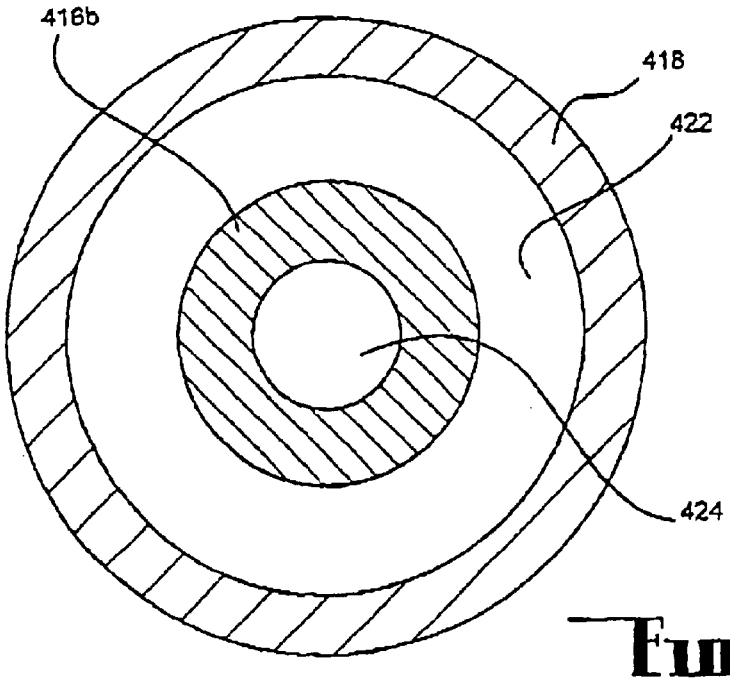

The fifth embodiment is directed towards a microwave resonator 410, shown in FIGS. 5(*a*) and 5(*b*). Like reference numerals they are used to denote like parts to those used in the second embodiment, with 300 added thereto.

The microwave resonator 410 in the current embodiment is of the same general form as the microwave resonator 110 in the second embodiment, the only difference being that the central piece 416*c* and the end pieces 416*a* and 416*e* each have an aperture 480 formed centrally therein which extends through each piece. This arrangement may increase the Q-factor of the resonator 410 compared with the resonator 110.

Figure 6A:
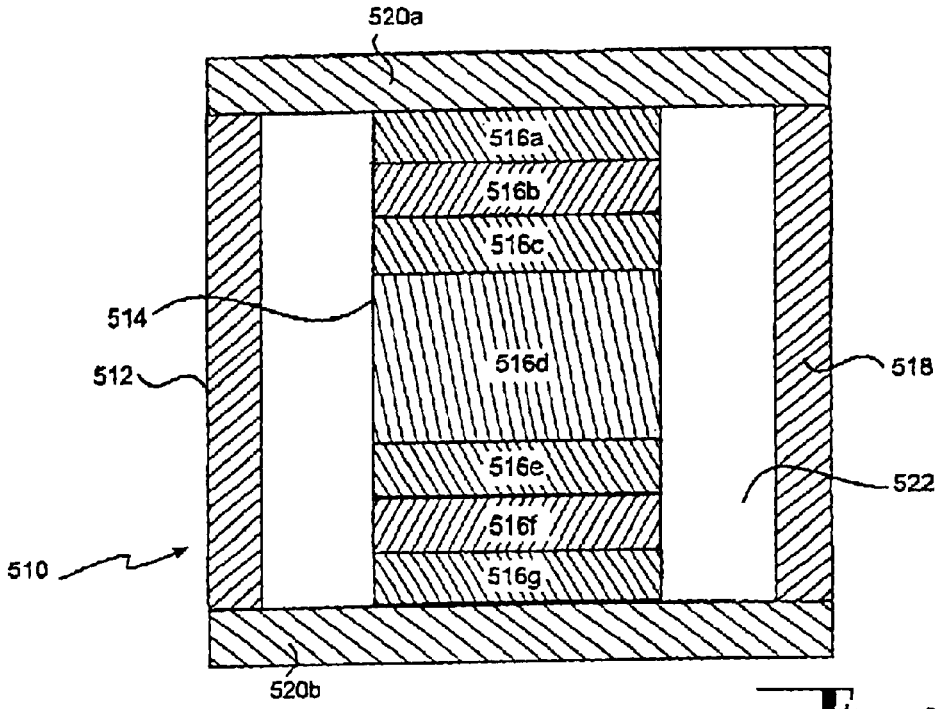
FIGS. 6(*a*) and 6(*b*) are elevation and plan cross-sections of a multi-layer microwave resonator in accordance with a sixth embodiment of this invention.
Figure 6B:
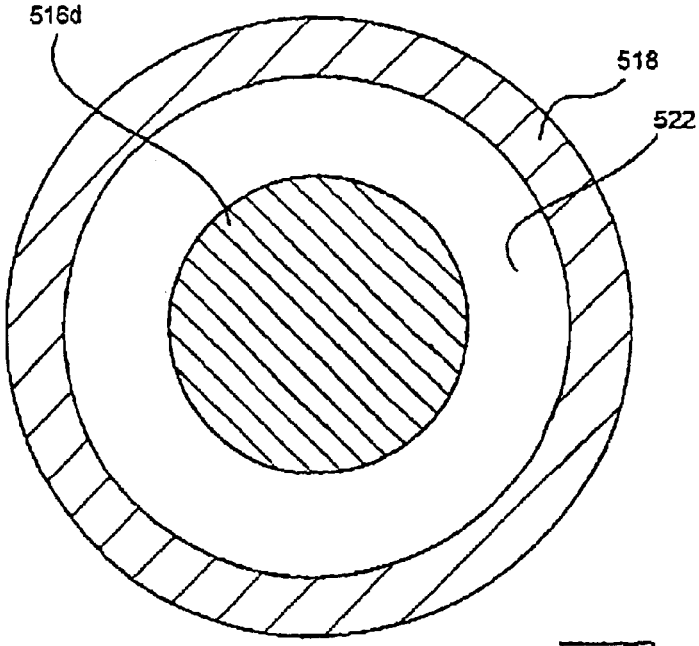

The sixth embodiment is directed towards a microwave resonator 510, shown in FIGS. 6(*a*) and 6(*b*). Like reference numerals they are used to denote like parts to those used in the first embodiment, with 500 added thereto.

The microwave resonator 510 in the current embodiment is of the same general form as the microwave resonator 10 in the first embodiment, the only difference being that the body 514 is formed from seven pieces of dielectric material 516*a*–516*g*. Thus, the end pieces 516*a* and 516*g* are formed from a dielectric material having a relatively high dielectric constant it should be appreciated that the scope of this invention is not limited to the particular embodiments described above.

For example, the multi-layer microwave resonator can be made with more than 7 layers or less than 5, as desired. Further, the diameter of the pieces of dielectric material 16(*a*)–16(*e*) can be adjusted according to requirements.

Further, it is envisaged that an opening can be provided within the body 14, preferably within the central piece 16(*c*) to receive test substances therein in order to examine the effects of exposure to microwave energies.

Further, it is envisaged that dielectric materials other than sapphire and rutile can be used.

What is claimed is:

1. A multi-layer microwave resonator, comprising:

a cavity having an inner surface formed from an electrically conductive material;

a plurality of pieces of dielectric materials stacked on top of each other to form a contiguous body, the body being provided in the cavity;

the body including a central piece of a first dielectric material having a relatively low dielectric constant, the central piece having a length substantially commensurate with an integer multiple of one-half wavelength of a desired operating frequency in the dielectric material;

wherein the dielectric materials of the pieces are chosen such that the dielectric constant of the pieces alternate between a relatively high dielectric constant and a relatively low dielectric constant.

2. A resonator as claimed in claim 1, wherein the dielectric materials of the pieces are chosen such that the thermal coefficient of dielectric constant of the pieces alternate between a positive thermal coefficient of dielectric constant and a negative thermal coefficient of dielectric constant.

3. A resonator as claimed in claim 1, wherein:

the body is formed of three pieces of dielectric materials, arranged as a central piece of a first dielectric material and two end pieces of a second dielectric material, the central piece being provided between the two end pieces;

the central piece of dielectric material having a length substantially commensurate with an integer multiple of one-half wavelength of a desired operating frequency in said first dielectric material;

each end piece having a length substantially commensurate with an odd integer multiple of one-half wavelength of the desired operating frequency in the second dielectric material;

the dielectric constant of the second dielectric material being greater than the dielectric constant of the first dielectric material.

4. A resonator as claimed in claim 1, wherein:

the body is formed of five pieces of dielectric materials, arranged as a central piece of a first dielectric material, two intermediate pieces of a second dielectric material and two end pieces of the first dielectric material, the central piece being provided between the two intermediate pieces, the central piece and the intermediate pieces being provided between the two end pieces;

the central piece of dielectric material having a length substantially commensurate with an integer multiple of one-half wavelength of a desired operating frequency in said first dielectric material;

each intermediate piece having a length substantially commensurate with an odd integer multiple of one-quarter wavelength of the desired operating frequency in the second dielectric material;

each end piece having a length substantially commensurate with an odd integer multiple of one-quarter wavelength of the desired operating frequency in the first dielectric material;

the dielectric constant of the second dielectric material being greater than the dielectric constant of the first dielectric material.

5. A resonator as claimed in claim 4, wherein:

an odd plurality of intermediate pieces of dielectric materials are provided between the central piece and each end piece;

each intermediate piece being formed from either the first dielectric material or the second dielectric material;

each intermediate piece having a length substantially commensurate with an odd integer multiple of one-quarter wavelength of the desired operating frequency in whichever of the first or second dielectric material said intermediate piece if formed from;

the intermediate pieces provided between the central piece and each end piece comprise alternate between an intermediate piece formed from the second dielectric material and an intermediate piece formed from the first dielectric material;

the intermediate pieces being arranged such that the pieces of dielectric materials forming the body alternate between pieces formed from the first dielectric material and pieces formed from the second dielectric material.

6. A resonator as claimed in claim 3, further comprising:

an even plurality of intermediate pieces of dielectric materials provided between the central piece and each end piece;

each intermediate piece being formed from either the first dielectric material or the second dielectric material;

each intermediate piece having a length substantially commensurate with an odd integer multiple of one-quarter wavelength of the desired operating frequency in whichever of the first or second dielectric material the intermediate piece of formed from;

the intermediate pieces provided between the central piece and each end piece comprise an equal number of intermediate pieces formed from the first dielectric material and intermediate pieces formed from the second dielectric material;

the intermediate pieces being arranged such that the pieces of dielectric materials forming the body alternate between pieces formed from the second dielectric material and pieces formed from the first dielectric material.

7. A resonator as claimed in any one on claims 6 to 5, wherein each intermediate piece formed from the second dielectric material has an aperture formed centrally therein.

8. A resonator as claimed in any one of claims 6 to 5, wherein each intermediate piece formed from the first dielectric material has an aperture formed centrally therein.

9. A resonator as claimed in any one of claims 6 to 5, wherein the central piece has an aperture formed centrally therein.

10. A resonator as claimed in any one of claims 6 to 5, wherein each end piece formed has an aperture formed centrally therein.

11. A resonator as claimed in any one of claims 3 to 5, wherein the central piece has an operating formed therein for receiving test substance.

12. A resonator as claimed in claim 1, wherein the first dielectric material is sapphire.

13. A resonator as claimed in claim 1, wherein the second dielectric material is rutile.

14. A resonator as claimed in claim 1, wherein the pieces of dielectric material are substantially cylindrical.

15. A resonator as claimed in claim 1, wherein the cavity comprises a cylindrical wall and two ends, the body being contained between the ends of the cavity.

16. A resonator as claimed in claim 15, wherein the cylindrical wall is spaced from the body.

17. A resonator as claimed in claim 15, wherein the cylindrical wall abuts the body.

* * * * *

UNITED STATES PATENT AND TRADEMARK OFFICE

CERTIFICATE OF CORRECTION

PATENT NO. : 6,882,252 B1
APPLICATION NO. : 09/914142
DATED : April 19, 2005
INVENTOR(S) : Cros et al.

It is certified that error appears in the above-identified patent and that said Letters Patent is hereby corrected as shown below:

Column 9, claim 7 lines 18-19- should read
7. A resonator as claimed in any one of claims [6 to 5] 4 to 6, wherein each intermediate piece formed from the second dielectric material has an aperture formed centrally therein.

Column 9 claim 8, lines 22-24 should read:
8. A resonator as claimed in any one of claims [6 to 5] 4 to 6, wherein each intermediate piece formed from the first dielectric material has an aperture formed centrally therein.

Column 10, claim 9, lines 1-3 should read:
9. A resonator as claimed in any one of claims [6 to 5] 4 to 6, wherein the central piece has an aperture formed centrally therein.

Column 10, claim 10, lines 4-6 should read:
10. A resonator as claimed in any one of claims [6 to 5] 4 to 6, wherein each end piece formed has an aperture formed centrally therein.

Column 10, claim 11, lines 7-9 should read:
11. A resonator as claimed in any one of claims [3 to 5] 3 to 6, wherein the central piece has an [operating] opening formed therein for receiving test substance.

Signed and Sealed this

Fifteenth Day of August, 2006

JON W. DUDAS
*Director of the United States Patent and Trademark Office*